US011162453B2

(12) United States Patent
Lormes et al.

(10) Patent No.: US 11,162,453 B2
(45) Date of Patent: Nov. 2, 2021

(54) PISTON

(71) Applicant: KS Kolbenschmidt GmbH, Neckarsulm (DE)

(72) Inventors: Klaus Lormes, Bad Wimpfen (DE); Willi Sikorsky, Neckarsulm (DE)

(73) Assignee: KS Kolbenschmidt GmbH, Neckarsulm (DE)

( * ) Notice: Subject to any disclaimer, the term of this patent is extended or adjusted under 35 U.S.C. 154(b) by 208 days.

(21) Appl. No.: 16/098,503

(22) PCT Filed: May 3, 2017

(86) PCT No.: PCT/EP2017/060534
§ 371 (c)(1),
(2) Date: Nov. 2, 2018

(87) PCT Pub. No.: WO2017/191189
PCT Pub. Date: Nov. 9, 2017

(65) Prior Publication Data

US 2019/0145344 A1 May 16, 2019

(30) Foreign Application Priority Data

May 4, 2016 (DE) ..... 102016108271.6

(51) Int. Cl.
*F02F 3/20* (2006.01)
*F02F 3/00* (2006.01)

(52) U.S. Cl.
CPC ..... *F02F 3/003* (2013.01); *F02F 3/0015* (2013.01); *F02F 3/20* (2013.01); *F02F 2003/0061* (2013.01)

(58) Field of Classification Search
CPC .. F02F 3/003; F02F 3/0015; F02F 3/20; F02F 3/0076; F02F 2003/0061; F16J 1/005; F16J 1/008
See application file for complete search history.

(56) References Cited

U.S. PATENT DOCUMENTS 1,526,491 A 2/1925 Cox
2,442,408 A 6/1948 Graham
(Continued)

FOREIGN PATENT DOCUMENTS

CH 230566 A 1/1944
CN 102407431 B 8/2013
(Continued)

OTHER PUBLICATIONS

International Search Report dated Oct. 22, 2013 for PCT/EP2013/067559.
(Continued)

*Primary Examiner* — Grant Moubry
*Assistant Examiner* — James G Moubry
(74) *Attorney, Agent, or Firm* — Young Basile Hanlon & MacFarlane, P.C.

(57) ABSTRACT

A piston for use in an internal combustion engine having a two-piece construction including an upper and a lower part. The upper and the lower parts include one or more overlapping cutouts to reduce the weight of the piston. One or more of the cutouts or connecting walls include wall regions that transition to adjacent walls without sharp or abrupt areas. The piston upper and lower parts are permanently joined together. One or more tongue and groove structures are used to provide a locking connection between the piston upper and lower parts.

18 Claims, 8 Drawing Sheets

(56) References Cited

U.S. PATENT DOCUMENTS

| | | | | |
|---|---|---|---|---|
| 3,029,112 | A * | 4/1962 | Bryan | F02F 3/0023 92/220 |
| 3,349,672 | A | 10/1967 | Meier et al. | |
| 3,354,793 | A | 11/1967 | Meier et al. | |
| 3,465,651 | A | 9/1969 | Tromel | |
| 3,596,571 | A | 8/1971 | Hill et al. | |
| 3,805,677 | A | 4/1974 | Clary et al. | |
| 3,877,351 | A | 4/1975 | Barfiss | |
| 3,882,021 | A | 5/1975 | Ayres | |
| 3,915,141 | A | 10/1975 | Ottl et al. | |
| 4,011,797 | A | 3/1977 | Cornet | |
| 4,286,505 | A | 9/1981 | Amdall | |
| 4,372,194 | A | 2/1983 | Vallaude | |
| 4,530,312 | A | 7/1985 | Kanda et al. | |
| 4,532,686 | A | 8/1985 | Berchem | |
| 4,651,631 | A | 3/1987 | Avezou | |
| 4,769,118 | A | 9/1988 | Johns | |
| 4,831,917 | A | 5/1989 | Houben et al. | |
| 4,838,149 | A | 6/1989 | Donnison et al. | |
| 5,070,768 | A | 12/1991 | Goncalves et al. | |
| 5,081,968 | A | 1/1992 | Bruni | |
| 5,150,517 | A | 9/1992 | Leites et al. | |
| 5,282,411 | A | 2/1994 | Hirai et al. | |
| 5,483,869 | A | 1/1996 | Bock et al. | |
| 5,553,378 | A | 9/1996 | Parekh et al. | |
| 5,626,113 | A * | 5/1997 | Pien | F02B 75/32 123/193.4 |
| 6,003,479 | A | 12/1999 | Evans | |
| 6,026,777 | A | 2/2000 | Kemnitz et al. | |
| 6,032,619 | A | 3/2000 | Zhu et al. | |
| 6,112,642 | A | 9/2000 | Jarrett et al. | |
| 6,155,157 | A | 12/2000 | Jarrett | |
| 6,170,441 | B1 | 1/2001 | Haldeman et al. | |
| 6,279,455 | B1 | 8/2001 | Kruse | |
| 6,327,962 | B1 | 12/2001 | Kruse | |
| 6,486,577 | B1 | 11/2002 | Ursel et al. | |
| 6,499,386 | B2 | 12/2002 | Martin et al. | |
| 6,651,549 | B2 | 11/2003 | Zhu et al. | |
| 6,698,391 | B1 | 3/2004 | Kemnitz | |
| 6,729,291 | B1 | 5/2004 | Scharp et al. | |
| 6,763,758 | B2 | 7/2004 | Kemnitz et al. | |
| 6,829,977 | B2 | 12/2004 | Messmer | |
| 6,938,537 | B2 | 9/2005 | Scharp | |
| 7,308,850 | B2 | 12/2007 | Scharp | |
| 7,690,237 | B2 | 4/2010 | Slack | |
| 7,971,355 | B2 | 7/2011 | Scharp | |
| 8,011,288 | B2 | 9/2011 | Gniesmer et al. | |
| 8,225,765 | B2 | 7/2012 | Kortas et al. | |
| 8,635,982 | B2 | 1/2014 | Scharp et al. | |
| 8,991,046 | B2 | 3/2015 | Schulz et al. | |
| 9,308,607 | B2 | 4/2016 | Scharp | |
| 2001/0051544 | A1 | 12/2001 | Kimoto et al. | |
| 2002/0050883 | A1 | 5/2002 | Miyazaki et al. | |
| 2003/0051694 | A1 | 3/2003 | Gaiser et al. | |
| 2004/0144247 | A1 | 7/2004 | Zhu et al. | |
| 2006/0005701 | A1 | 1/2006 | Huang | |
| 2006/0037471 | A1 | 2/2006 | Zhu et al. | |
| 2006/0081480 | A1 | 4/2006 | Bayer et al. | |
| 2006/0207424 | A1 | 9/2006 | Gaiser | |
| 2007/0295299 | A1 | 12/2007 | Lapp et al. | |
| 2009/0020007 | A1 | 1/2009 | Lin et al. | |
| 2009/0151555 | A1 | 6/2009 | Lapp et al. | |
| 2010/0006055 | A1 | 1/2010 | Garcia et al. | |
| 2010/0037765 | A1 | 2/2010 | Gniesmer et al. | |
| 2010/0108017 | A1 | 5/2010 | Bing et al. | |
| 2010/0275873 | A1 | 11/2010 | Gniesmer et al. | |
| 2010/0299922 | A1 | 12/2010 | Gniesmer et al. | |
| 2011/0197845 | A1 | 8/2011 | Flowers et al. | |
| 2012/0037111 | A1 | 2/2012 | Scharp et al. | |
| 2012/0037115 | A1 | 2/2012 | Schnaiter et al. | |
| 2012/0160203 | A1 | 6/2012 | Scharp | |
| 2012/0160204 | A1 | 6/2012 | Scharp et al. | |
| 2012/0222645 | A1 | 9/2012 | Edel et al. | |
| 2012/0258007 | A1 * | 10/2012 | Walker | F16J 1/005 419/9 |
| 2012/0260869 | A1 | 10/2012 | Freidhager | |
| 2013/0062218 | A1 | 3/2013 | Michael et al. | |
| 2013/0068096 | A1 | 3/2013 | Gabriel et al. | |
| 2013/0133610 | A1 | 5/2013 | Gniesmer | |
| 2013/0027674 | A1 | 10/2013 | Wandrie, III et al. | |
| 2013/0276740 | A1 * | 10/2013 | Wandrie, III | B23K 20/129 123/193.6 |
| 2014/0102294 | A1 | 4/2014 | Klein | |
| 2014/0260957 | A1 * | 9/2014 | Hempston | F02F 3/003 92/172 |
| 2017/0241374 | A1 * | 8/2017 | Scherbaum | F02F 3/22 |

FOREIGN PATENT DOCUMENTS

| | | | |
|---|---|---|---|
| DE | 475508 | C | 4/1929 |
| DE | 901104 | C | 1/1954 |
| DE | 1103698 | B | 3/1961 |
| DE | 2212922 | A1 | 9/1973 |
| DE | 106677 | A2 | 6/1974 |
| DE | 123962 | A1 | 1/1977 |
| DE | 123962 | C | 1/1977 |
| DE | 2537182 | A1 | 3/1977 |
| DE | 3713191 | C1 | 7/1988 |
| DE | 4018252 | A1 | 12/1991 |
| DE | 4134528 | A1 | 5/1992 |
| DE | 9407385 | U1 | 7/1994 |
| DE | 19959593 | A1 | 6/2001 |
| DE | 10022035 | A1 | 11/2001 |
| DE | 10047258 | A1 | 4/2002 |
| DE | 10145589 | A1 | 4/2003 |
| DE | 10319230 | A1 | 11/2004 |
| DE | 10 2004 003980 | A1 | 8/2005 |
| DE | 102004028459 | A1 | 12/2005 |
| DE | 102004031513 | A1 | 1/2006 |
| DE | 102004038465 | A1 | 2/2006 |
| DE | 102994038465 | | 2/2006 |
| DE | 102005041001 | A1 | 3/2007 |
| DE | 102006002949 | A1 | 8/2007 |
| DE | 102007005268 | A1 | 8/2007 |
| DE | 102006046765 | A1 | 4/2008 |
| DE | 10 2006 055251 | A1 | 5/2008 |
| DE | 102007036236 | | 2/2009 |
| DE | 102007044106 | A1 | 3/2009 |
| DE | 102007061601 | A1 | 6/2009 |
| DE | 10 2008 035698 | A1 | 2/2010 |
| DE | 102009041392 | A1 | 5/2011 |
| DE | 10 2010 033881 | A1 | 2/2012 |
| DE | 102010056220 | A1 | 6/2012 |
| DE | 102014204774 | A1 | 9/2014 |
| DE | 10 2016 116 046 | A1 | 3/2017 |
| EP | 0144145 | A2 | 6/1985 |
| EP | 0604223 | A1 | 6/1994 |
| EP | 877160 | A1 | 11/1998 |
| EP | 0877160 | A1 | 11/1998 |
| EP | 1061249 | A2 | 12/2000 |
| EP | 1084793 | A1 | 3/2001 |
| EP | 1180592 | A2 | 2/2002 |
| EP | 1611975 | A1 | 1/2006 |
| EP | 1614885 | A2 | 1/2006 |
| EP | 1878902 | A2 | 1/2008 |
| EP | 1905996 | A1 | 4/2008 |
| EP | 2028357 | A1 | 2/2009 |
| EP | 180988591 | B1 | 10/2010 |
| FR | 663296 | A | 8/1929 |
| FR | 1451838 | A | 1/1966 |
| FR | 2371581 | A1 | 6/1978 |
| FR | 2668090 | A1 | 4/1992 |
| GB | 748735 | A | 5/1956 |
| GB | 1092720 | A | 11/1967 |
| GB | 2033525 | A | 5/1980 |
| GB | 2 366 607 | A | 3/2002 |
| JP | 52031213 | | 3/1977 |
| JP | S554359 | B2 | 1/1980 |
| JP | S59 168556 | U | 11/1984 |
| JP | 60166158 | | 8/1985 |
| JP | S60178345 | U | 11/1985 |
| JP | S6441649 | U | 3/1989 |
| JP | 2091452 | | 3/1990 |
| JP | 2001 082247 | A | 3/2001 |

(56) References Cited

FOREIGN PATENT DOCUMENTS

| | | | |
|---|---|---|---|
| JP | 2001304125 | A | 10/2001 |
| JP | 2003025076 | A | 1/2003 |
| SU | 1518562 | A1 | 10/1989 |
| WO | 2007/068222 | A1 | 6/2007 |
| WO | 2007144111 | A1 | 12/2007 |
| WO | 2011/072657 | A1 | 6/2011 |
| WO | 2012010285 | A1 | 1/2012 |
| WO | 2012/083929 | A2 | 6/2012 |
| WO | 2013007238 | A1 | 1/2013 |

OTHER PUBLICATIONS

International Search Report dated Feb. 11, 2006 for PCT/EP/2006/007638.
Dopy of the English Translation of the International Preliminary Report on Patentability dated Apr. 8, 2006 for PCT/EP2006/007638.
Written Finding of the International Search Authority for PCT/EP2006/010033.
Written Opinion of the International Search Authority for PCT/EP2007/005456.
International Preliminary Report on Patentability for PCT/EP2005/010061.
International Search Report dated Jul. 11, 2012 for PCT/EP2013/069368.

* cited by examiner

PISTON

FIELD OF INVENTION

The invention relates to a piston of an internal combustion engine.

BACKGROUND

Known pistons with a so-called "slipper" design are known and are used if it is sought to reduce the weight of the piston. Moreover, in the case of such pistons of the type in question, the connecting walls which connect the mutually opposite piston skirts (also referred to as supporting skirt wall portions) are obliquely positioned and in each case accommodate one pin bore. It has been shown in practice by this oblique position that the combustion forces acting on the piston can be transmitted very well and the deformation of the piston resulting therefrom is effectively limited. In addition, the separate production of a lower part and of an upper part, which are joined together after their production, is of advantage since certain elements of the piston are better accessible prior to the joining-together operation than would be the case after the joining-together operation.

A piston of the type in question is known from DE 10 2005 041 001.

SUMMARY

The invention relates to a piston of an internal combustion engine, formed from an upper part which is joined together with a lower part, wherein the lower part is formed from mutually opposite, obliquely positioned connecting walls which are set back with respect to the outside diameter of the piston, wherein in each case one connecting wall has a pin bore and the respective end of each connecting wall merges into a piston skirt.

The object on which the invention is based is to provide a piston of an internal combustion engine which, by comparison with pistons of the type in question, is improved in terms of its production but in particular in which the weight is also further reduced without the stability of the piston during operation in the cylinder of the internal combustion engine being limited as a result.

According to the invention, there is provision that the lower part has at least one cutout which faces in the direction of the upper part and the upper part has at least one cutout which faces in the direction of the lower part, wherein the cutouts overlap after the joining-together operation, wherein, furthermore, a permanent connection between the lower part and the upper part is a positively locking connection and the positively locking connection is formed by at least one tongue and at least one groove which can be brought into operative connection therewith. By virtue of this at least one cutout, preferably a plurality of cutouts per lower part and per upper part, it is possible for material savings to be made locally in order to reduce the weight of the piston after it has been joined together. As a result of the overlapping of the cutouts in the upper part and in the lower part, sharp-edged transitions between the two parts are avoided in order thereby to be able to avoid crack formations, in particular when a joining operation, such as, for example, a welding operation or the like, has taken place in the transition region between upper part and lower part. The overlapping of the two parts can be realized in a positionally accurate manner by the positively locking connection, with the result that a defined position of the upper part with respect to the lower part is always already predefined either by the positively locking connection (with the result that the two parts no longer have to be moved relative to one another after being brought together) or a defined position can be established by relative movement of the two parts with respect to one another.

In a development of the invention, the at least one cutout of the lower part (and thus correspondingly also the cutout of the upper part) is arranged above and outside of the connecting wall. Consequently, the at least one local cutout formed by the joining-together of upper part and lower part is arranged below the upper part of the piston and is situated outside of the inner region of the piston, with the result that material can be saved at points in which the piston is not highly loaded.

Alternatively or in addition thereto, there is provision according to the invention that the at least one cutout of the lower part (and thus also the corresponding at least one cutout of the upper part) is arranged above and inside of the two connecting walls. By this means, too, material of the piston can be saved reduced at points which are arranged above the inner region, that is to say between the two connecting walls and the two mutually opposite supporting skirt wall portions. This applies in particular when the piston has no combustion-space recess. Valve pockets which are of flat design can, but do not have to, be present.

In a development of the invention, there is provision that a wall region of the connecting wall merges in a transition-free manner into a wall region of the at least one cutout of the lower part. If the at least one cutout in the lower part (and also in the upper part) is arranged above the connecting wall, it is of advantage that a transition from the wall region of the connecting wall into the wall region of the at least one local cutout merges in a transition-free manner, with the result that sharp-edged transitions, step-like transitions or the like, are also avoided here in order to counteract a crack formation. This transition-free transition can, but does not have to, be arranged in the region of a joining plane between upper part and lower part. Moreover, it can be realized very simply in an advantageous manner by the positively locking connection (tongue-and-groove principle).

In one particular embodiment of the invention, there is provision that one cutout of the lower part is arranged above the pin bore and in each case one cutout of the lower part is arranged above and next to the pin bore. By virtue of this symmetrical arrangement of three local cutouts, there is a substantial saving of material on the one hand, and, by virtue of the regions (webs) remaining between the local cutouts, a very good support of the upper part with respect to the combustion pressures acting on the piston is achieved on the other hand.

BRIEF DESCRIPTION OF THE DRAWINGS

The invention is explained below in more detail below with reference to an exemplary embodiment, to which the invention is not limited, however, and is shown in the figures.

DETAILED DESCRIPTION

Figure 1:
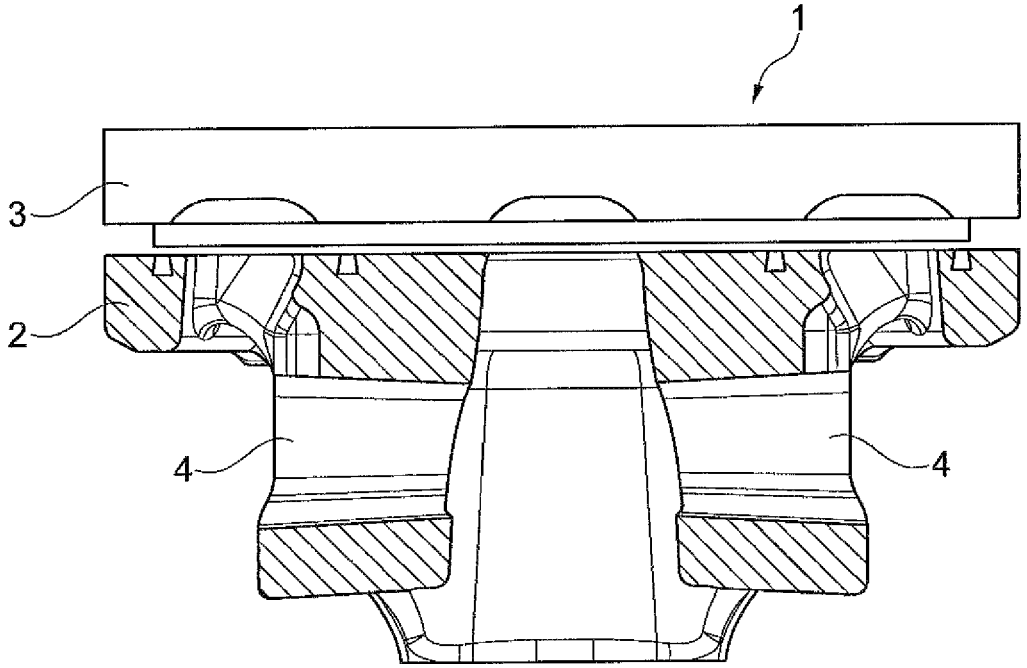
FIG. 1 is an exploded, partial sectional view of one example of the invention.

FIG. 1 shows a not yet operationally ready piston 1 which is formed from a lower part 2 and an upper part 3. These two parts 2, 3 are manufactured separately from one another in a suitable manner (identical or mutually different materials, identical or mutually different production methods and the like). A pin bore is designated by 4 in FIG. 1.

Figure 2:
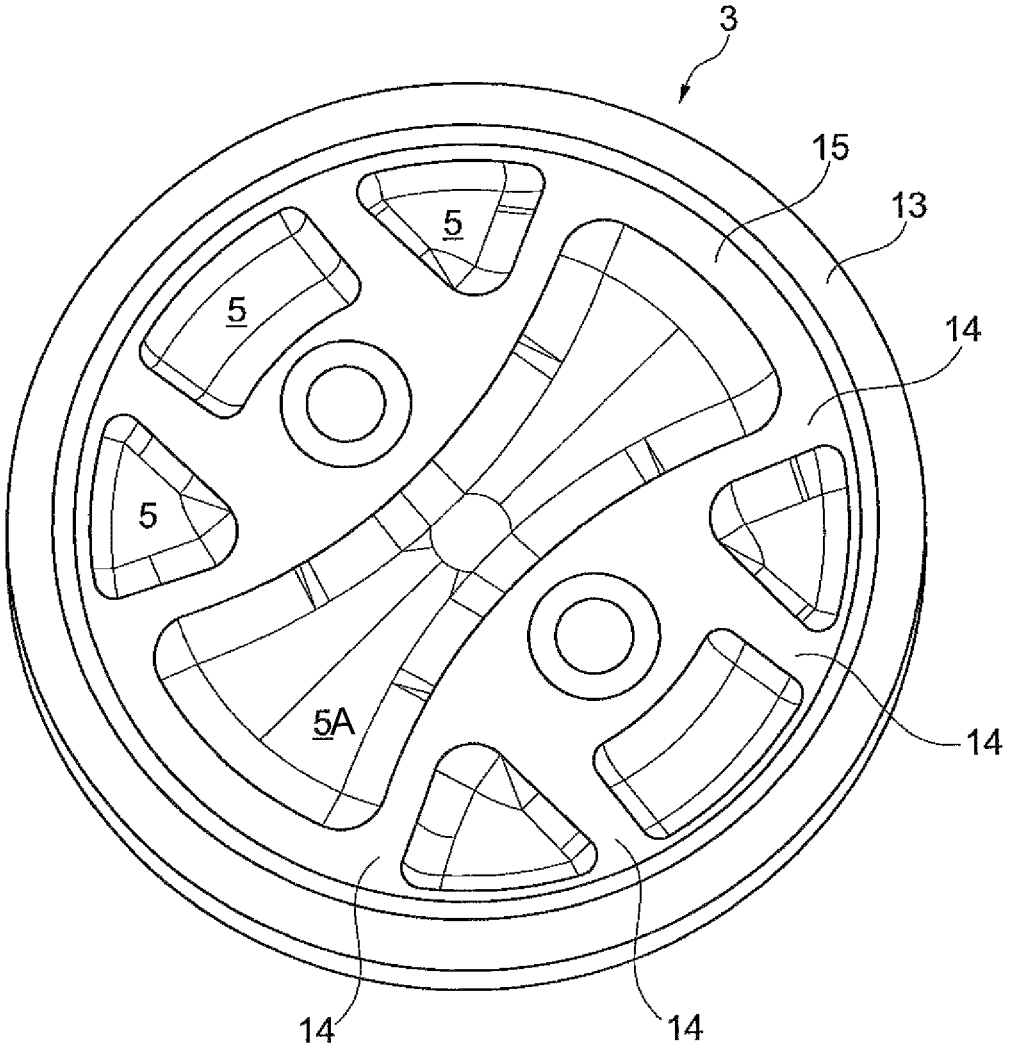
FIG. 2 is a bottom plan view of one example of a piston upper part.

FIG. 2 shows the upper part 3 in a plan view from below, wherein the illustrated plane faces the lower part 2 when these two parts 2, 3 are joined together. It can be seen that the upper part 3 has at least one local cutout, here in each case three local cutouts 5 symmetrically to a transverse axis of the upper part 3. The position and number of the cutouts 5 is exemplary and can vary in terms of position and/or number. Also present is a central local cutout 5A which is arranged with respect to the transverse axis of the upper part 3.

The remaining details of this upper part 3 which are provided in FIG. 2 with reference numbers will be described below in connection with corresponding embodiments of the lower part 2.

Figure 3:
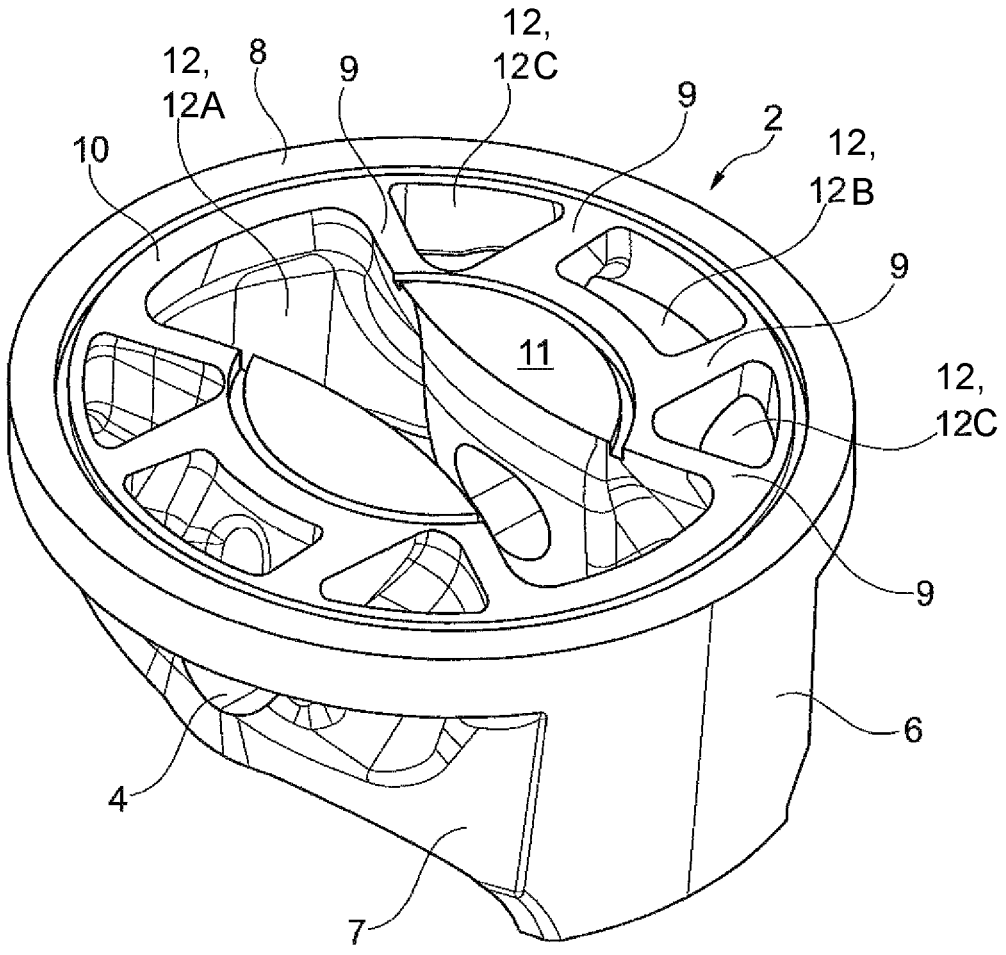
FIG. 3 is a perspective view of one example of the piston lower part.

FIG. 3 shows the lower part 2, which comprises a piston skirt 6 to which a further piston skirt (not shown) is correspondingly oppositely opposite. This piston skirt 6 is designed as a supporting skirt wall portion and is connected by two obliquely positioned connecting walls extending approximately in parallel (obliquely positioned with respect to the piston stroke axis).

In order to form bearing surfaces between the lower part 2 and the upper part 3, it is possible, for example, for an outer ring 8 to be present from which at least one web, here a plurality of webs 9, extend in the direction of the center of the piston. These webs 9 can start from the outer ring 8, specifically in the same plane or in a plane arranged offset thereto. In the case of the lower part 2 according to FIG. 3, an inner ring 10 is also present concentrically within the outer ring 8, wherein the outer ring 8 is arranged in a different plane than the inner ring 10 and possibly the webs 9. Also present is a central region 11 which, in this example, is likewise arranged in a different plane than in the planes in which outer ring 8, webs 9, and inner ring 10 are situated. As a result there is formed, between the outer ring 8 and the inner ring 10 and/or the inner ring 10 and the central region 11, one groove or two grooves in the lower part 2 to form a part of the positively locking connection.

However, it is also conceivable and evident on viewing the Figure that the outer ring 8 and the peripheral region, extending parallel thereto, at the outwardly facing end of the webs 9 (that is to say the inner ring 10) and/or the inner ring 10 and the central region 11 are arranged in one and the same plane. As a result there is also formed in this variant, between the outer ring 8 and the inner ring 10 and/or the inner ring 10 and the central region 11, one groove or two groves in the lower part 2 to form a part of the positively locking connection.

The reference number 12 designates at least one cutout in the lower part 2 which can in principle be provided at a suitable point for the purpose of saving material.

In the case of the exemplary embodiment according to FIG. 3 there are present, in a corresponding manner to the cutouts 5 in the upper part 3 according to FIG. 2, a central cutout 12A which extends within the central region 11 and in the direction of the piston skirts 6 and which is thus situated above a central region of the lower part 2. Also present is a transverse cutout 12B (or two cutouts 12B (as shown)) symmetrically to a transverse axis of the lower part 2) which is arranged above the pin bore 4. In addition to this transverse cutout 12B arranged above the pin bore 4, in each case one adjacent cutout 12C are present to the right and left next to and above the pin bore 4.

The outer ring 8 of the lower part 2 corresponds with an outer ring 13 (FIG. 2) of the upper part 3. Equally, the respective web 9 of the lower part 2 corresponds with associated webs 14 (FIG. 2) of the upper part 3. The inner ring 10 also corresponds with an inner ring 15 (FIG. 2) of the upper part 3.

As is evident on viewing the two parts 2, 3 according to FIGS. 2 and 3, the mutually facing bearing surfaces and the respective local cutouts are preferably symmetrical and overlapping for the purpose of saving weight. The same can also, but does not have to, apply to the central region 11, as can be seen from FIG. 2.

It is very clearly evident on viewing FIG. 3 that the wall region of the cutouts 12A, B and C arranged above and next to the pin bore merge into the wall region of the connecting wall in a transition-free manner. The same applies to the case in which the cutouts 12B and C of the lower part 2 merge into the corresponding respective cutouts 5 of the upper part 3. The cutouts 5, 5A, 12A, 12B, 12C which overlap preferably likewise have no transition after the joining-together operation.

Figure 4:
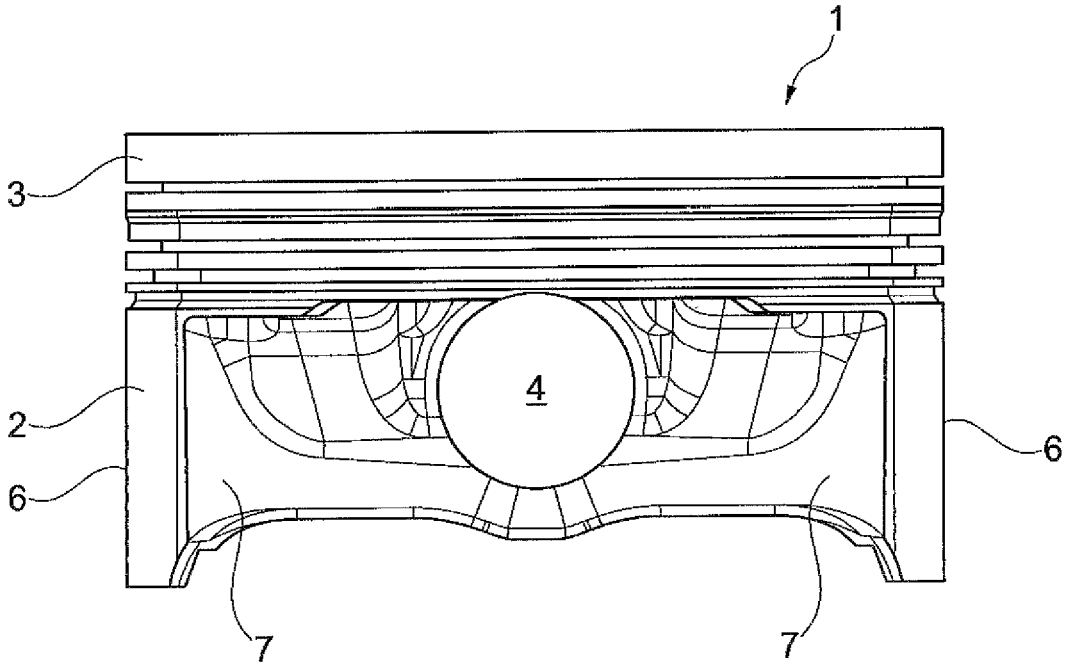
FIG. 4 is a side view of one example of the invention.

FIG. 4 shows an operationally ready piston 1 in which the lower part 2 and the upper part 3 have been nonreleasably (or permanently) joined to one another in a suitable manner. There can additionally be seen the mutually opposite piston skirts 6 and the connecting walls 7 which connect the piston skirts 6 and in which the pin bore 4 is arranged.

The operationally ready piston 1 illustrated in FIG. 4 has been reworked after joining together the two parts 2, 3 and, in particular, ring grooves for forming a ring zone have been incorporated.

Figure 5:
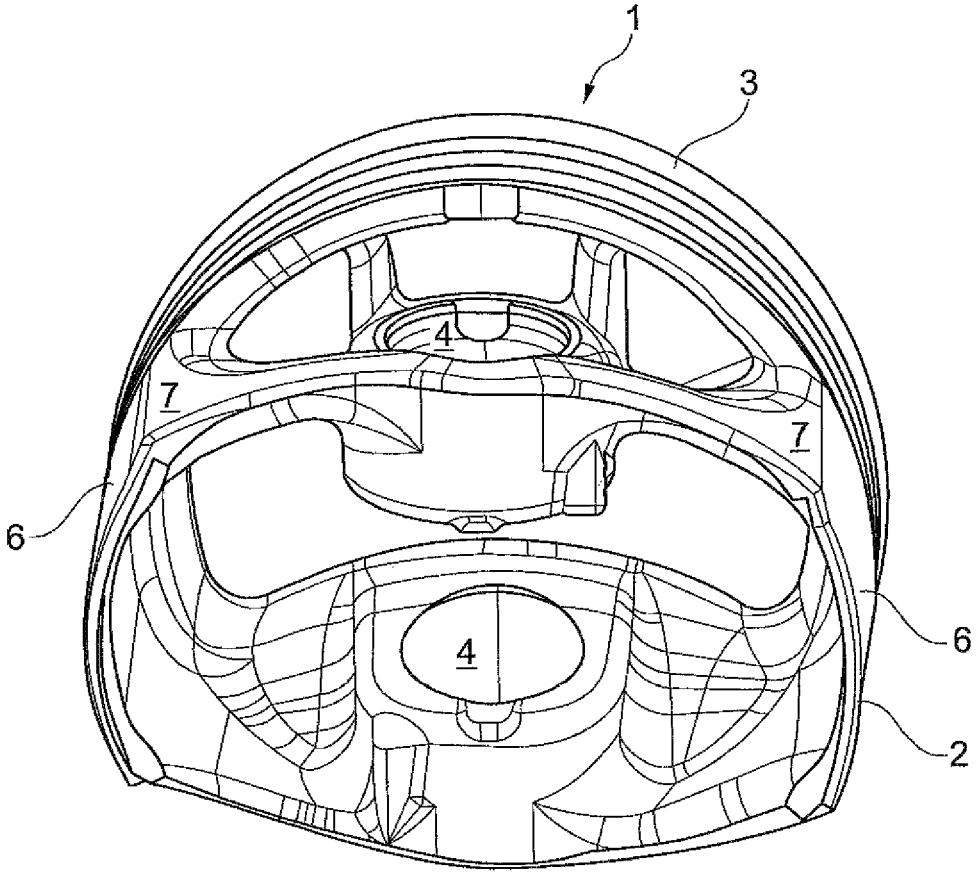
FIG. 5 is a perspective view of the piston in FIG. 4.

FIG. 5 shows the piston according to FIG. 4 in a view from below. Here, there can be seen in particular the horizontal and vertical profile of the connecting walls 7 which also comprise the pin bosses surrounding the pin bore 4. This outwardly directed profile and the profile or shaping of the connecting walls 7 that is directed into the inner region of the piston 1 is particularly important since they support the incorporation of the local cutouts in the two parts 2, 3 and at the same time support the piston crown (formed by the upper part 3) in an optimum manner.

The design of the two parts 2, 3, as have been shown in FIGS. 1 to 5 and described above, advantageously allows these two parts 2, 3 to be joined permanently and nonreleasably to one another by means of an integrally bonded connection, in particular by means of a welded connection.

FIGS. 6 to 9 show an exemplary embodiment of a piston 1 which to the largest possible extent has the same design details as the piston 1 according to FIGS. 1 to 5.

Figure 6:
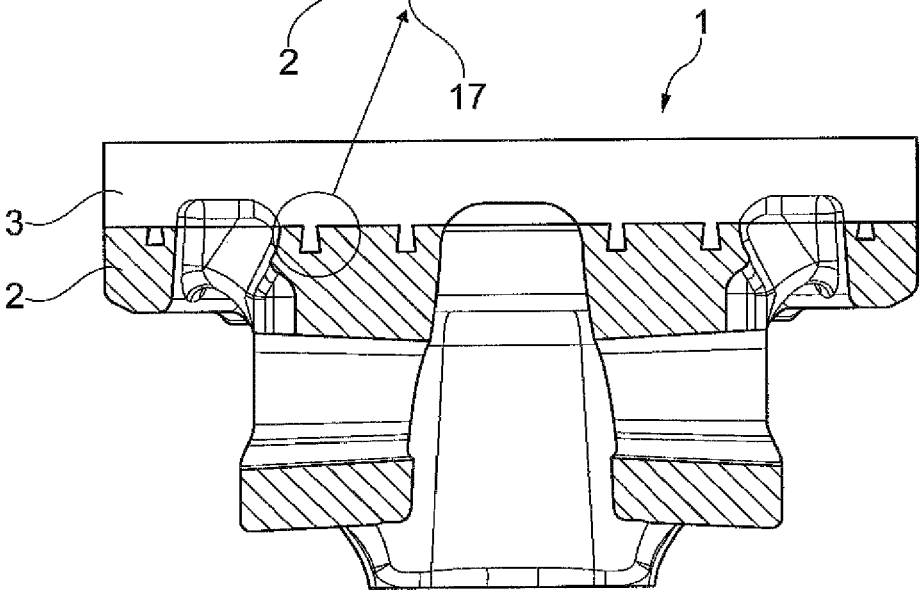
FIG. 6 is a partial sectional view of one embodiment of the invention.
Figure 8:
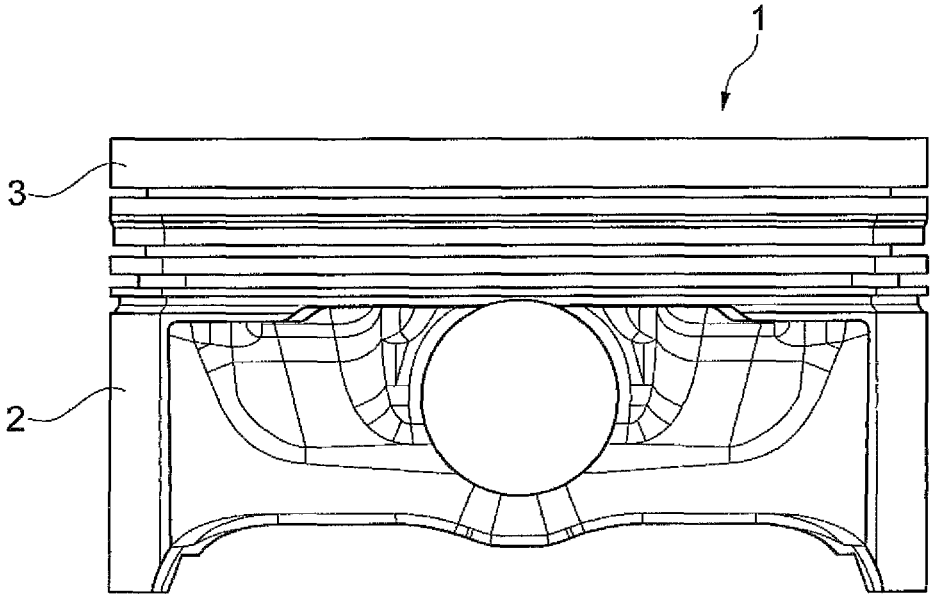
FIG. 8 is a side view of one example of the invention.
Figure 9:
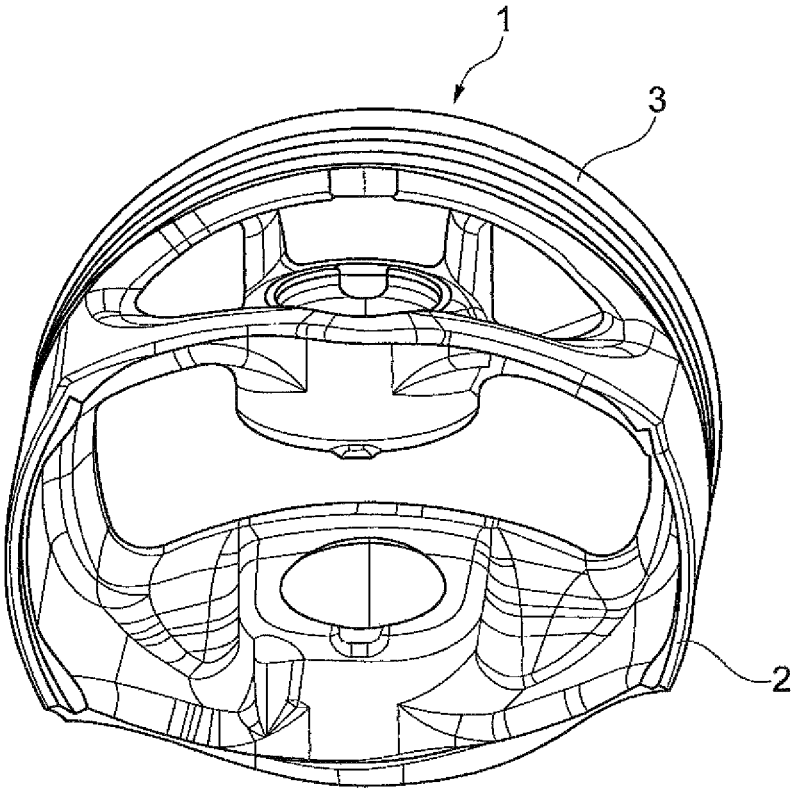
FIG. 9 is a perspective view of one example of the invention.

However, in the case of the piston 1 according to FIG. 6, there is provision that a permanent connection between the lower part 2 and the upper part 3 is a positively locking connection.

Figure 7:
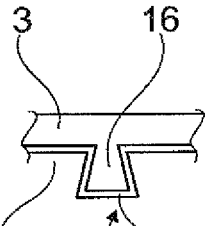
FIG. 7 is an enlarged view of one portion of FIG. 6.

This positively locking connection is formed, as is illustrated in FIG. 7, by at least one tongue 16 and at least one groove 17 which can be brought into operative connection therewith. The tongue 16 can be arranged for example on the upper part 3 and the groove 17 on the lower part 2 (and/or vice versa). Moreover, not only one single such tongue-and-groove system is present in a distributed manner over the periphery of the piston 1, but this system is, as illustrated in FIG. 6, repeatedly present. Pressing the at least one tongue 16 into the at least one corresponding groove 17 likewise realizes a nonreleasable connection between the upper part 3 and the lower part 2. This can, but does not have to, be supplemented by an integrally bonded connection.

The invention claimed is:

1. A piston of an internal combustion engine, including an upper part joined together with a lower part, wherein the lower part includes mutually opposite, obliquely positioned connecting walls which are positioned set back with respect to the outside diameter of the piston, wherein in each connecting wall defines a pin bore and a respective end of each connecting wall merges into a piston skirt, characterized in that:

the lower part defines at least one lower part cutout including a through transverse cutout positioned above and radially outside of one of the connecting walls, the through transverse cutout extending through the lower part and facing in a direction of the upper part;

the upper part defines at least one upper part cutout which faces in a direction of the lower part, wherein the upper part cut out and the lower part cutout overlap after a joining-together operation of the upper part and the lower part; and a permanent connection between the lower part and the upper part comprising a positively locking connection further comprising at least one tongue and at least one groove operable to cooperatively connectively engage with one another.

2. The piston of claim 1 wherein the at least one lower part cutout is further defined by a through central cutout, wherein the lower part central cutout is positioned above and radially inside of the two connecting walls.

3. The piston of claim 2 wherein each connecting wall further comprises a wall region, the connecting wall region merges in a transition-free manner into a wall region of each of the lower part through transverse and through central cutouts.

4. The piston of claim 2 wherein the at least one lower part cutout further defines a through adjacent cutout extending through the lower part and facing the upper part, the through adjacent cutout is angularly separated and positioned from the through transverse cutout.

5. The piston of claim 4 wherein the lower part through transverse cutout and the through adjacent cutout is separated by at least one web which extends in a direction of a central region of the piston starting from an outer ring of the lower part.

6. The piston of claim 5, wherein the lower part further comprises at least one inner ring which is positioned in a plane offset to the outer ring and coaxially to said outer ring.

7. The piston of claim 6 wherein the outer ring is positioned on a different plane than the at least one web, the inner ring and the central region.

8. The piston of claim 5 wherein the lower part further comprises at least one inner ring which is positioned coaxially to said outer ring, and wherein the outer ring and a peripheral region extending parallel thereto, the at least one web, the at least one inner ring and the central region are positioned in the same plane.

9. The piston of claim 5 wherein the at least one web comprises a plurality of webs, the lower part through central cutout, the lower part through transverse cutout and the lower part through adjacent cutout are each separated by one of the plurality of webs.

10. The piston of claim 1 further comprising a permanent connection between the lower part and the upper part, wherein the permanent connection is an integrally bonded welded connection.

11. A piston for use in an internal combustion engine comprising:

a lower part having an axial piston stroke axis comprising:

an outer ring positioned radially distant from the piston stroke axis;

an inner ring connected to the outer ring and positioned radially inward from the outer ring;

a central region connected to the inner ring and positioned radially inward from the inner ring;

opposing piston skirts connected to the outer ring;

a pair of connecting walls positioned transverse to the opposing piston skirts and connected thereto, each of the pair of connecting walls defining a pin bore aligned along a pin bore axis, the lower part defining at least one cutout including a through transverse cutout extending through the lower part positioned above and radially outward of one of the pair of connecting walls and radially inward from the outer ring;

an upper part operable to be permanently connected to the lower part, the upper part further comprising:

an outer ring positioned radially distant from the piston stroke axis and radially aligned with the lower part outer ring;

an inner ring connected to the outer ring and positioned radially inward from the upper part outer ring, upper part inner ring radially aligned with the lower part inner ring, the upper part defining at least one cutout positioned radially inward from the upper part outer ring and aligned with the lower part at least one cutout; and a positive locking connection including a tongue extending from one of the upper part or the lower part and a coordinating groove defined by the other of the upper part or the lower part, wherein on connection of the upper part to the lower part, the tongue engages the groove thereby connecting the upper part to the lower part.

12. The piston of claim 11 wherein the at least one lower part cutout further comprises:

a pair of through adjacent cutouts extending through the lower part, each of the through adjacent cutouts angularly separated and positioned on opposite sides of the through transverse cutout.

13. The piston of claim 12 wherein the upper part at least one cutout further comprises:

a transverse cutout overlapping with the lower part through transverse cutout; and a pair of adjacent cutouts, each of the adjacent cutouts circumferentially positioned on opposite sides of the transverse cut out, the upper part respective adjacent cutouts overlapping with the lower part respective through adjacent cutouts.

14. The piston of claim 13 wherein the piston upper and lower parts each further define a central cutout positioned between the pair of connecting walls, the central cutout of the upper part overlaps with the central cutout of the lower part.

15. The piston of claim 11 wherein the lower part inner ring is positioned on a plane transverse to the piston stroke axis that is axially lower than a plane of the lower part outer ring.

16. The piston of claim 15 wherein the lower part central region is positioned on a plane transverse to the piston stroke axis that is axially lower than the lower part inner ring plane.

17. The piston of claim 11 wherein the positive locking connection includes a plurality of individual tongues and corresponding grooves linearly separated from one another and positioned in a vertical plane through the pin bore axis.

18. The piston of claim 17 wherein the plurality of individual tongues and corresponding grooves are positioned about a periphery of the respective upper and lower parts.

* * * * *